United States Patent [19]

Clark

[11] Patent Number: 4,756,044

[45] Date of Patent: Jul. 12, 1988

[54] TIRE BRUSH

[76] Inventor: Gaylord J. Clark, 4769 Paw Paw Lake Rd., Coloma, Mich. 49038

[21] Appl. No.: 7,170

[22] Filed: Jan. 27, 1987

[51] Int. Cl.[4] ..... A46B 13/02; A46B 9/06

[52] U.S. Cl. ..... 15/182; 15/159 A; 15/DIG. 5; 51/332; 51/352

[58] Field of Search ..... 15/181, 182, 183, 159 A, 15/DIG. 5, DIG. 6; 51/331, 332, 334, 352

[56] References Cited

U.S. PATENT DOCUMENTS

| | | | |
|---|---|---|---|
| 1,142,698 | 6/1915 | Grove | 15/DIG. 6 X |
| 2,226,529 | 12/1940 | Austin | 15/159 A |
| 2,754,531 | 7/1956 | Rowland | 15/183 |
| 2,812,530 | 11/1957 | Whitesel | 15/159 A |
| 2,978,726 | 4/1961 | Park | 15/183 |
| 3,181,193 | 5/1965 | Nobles | 15/DIG. 6 X |
| 3,295,156 | 1/1967 | Brant | 15/DIG. 5 X |
| 3,761,986 | 10/1973 | Rickel | 15/183 X |
| 4,305,234 | 12/1981 | Pichelman | 15/DIG. 6 X |

FOREIGN PATENT DOCUMENTS

| | | | |
|---|---|---|---|
| 1272881 | 7/1968 | Fed. Rep. of Germany | 15/181 |
| 1321081 | 6/1973 | United Kingdom | 15/182 |
| 1572804 | 8/1980 | United Kingdom | 15/DIG. 6 |

OTHER PUBLICATIONS

Custom Built Brush Co. Brochure, 8 pages, (1971).

*Primary Examiner*—Harvey C. Hornsby
*Assistant Examiner*—Kim L. O'Leary
*Attorney, Agent, or Firm*—Flynn, Thiel, Boutell & Tanis

[57] ABSTRACT

A rotatable tire brush for a vehicle washing apparatus, which brush includes a plurality of abrasive bristles defining a first cylindrical array, and a plurality of nonabrasive bristles defining a second cylindrical array. The abrasive and nonabrasive bristles are dispersed in a uniform pattern throughout the first and second cylindrical arrays, and the outer diameter of the second cylindrical array is greater than the outer diameter of the first array. The tip ends of the nonabrasive bristles are preferably flagged to provide the brush with an outer fluffy layer.

7 Claims, 1 Drawing Sheet

TIRE BRUSH

FIELD OF THE INVENTION

This invention relates to an improved tire brush, such as used in a car wash, for permitting automatic cleaning of white sidewall tires while minimizing the risk of damaging the aluminum wheel parts which are commonly utilized on many vehicles.

BACKGROUND OF THE INVENTION

Car washes typically provide rotatable wheel brushes which are disposed along the wash path and are spring urged inwardly for brushing engagement with the vehicle wheels as the latter moves through the washing apparatus. The tire brush is typically of small diameter but of substantial axial length, and is oriented for rotation about a generally horizontal axis so as to engage the exposed side of the vehicle tire to effect cleaning thereof. While cleaning of tires, particularly white sidewall tires, has long been a serious problem, nevertheless this problem is becoming more complex for car wash operators in view of changes both in automotive design and in control of pollutants generated during the washing operation. While it has been conventional to utilize rather strong chemicals in conjunction with the tire brush in order to clean and whiten the sidewalls of vehicle tires, nevertheless such chemicals can cause damage to the car parts and also undesirably pollute the sewage system. The use of such chemicals is being eliminated or minimized.

To effectively clean white sidewalls, particularly in the absence of cleaning chemicals, tire brushes have been constructed utilizing bristles made of silicon carbide-impregnated nylon filaments (a typical material being manufactured by E. I. DuPont and sold under the trademark TYNEX "A"). Anything less abrasive than this silicon carbide-impregnated filament has been found to be ineffective for cleaning white sidewalls, and tire brushes employing abrasive bristles of this type are now rather universally utilized.

However, more vehicles are now being manufactured employing aluminum rims and/or hubcaps, which rims and caps typically have a soft protective coating provided thereon. The current tire brushes employing silicon carbide-impregnated bristles, however, are sufficiently aggressive that if they rub against the coated aluminum surfaces, the bristles can cause damage by effecting removal of the coating and scratching of the underlying aluminum surface. This scratching and damage is caused when the tire penetrates too far into the brush allowing the aggressive and abrasive material of the bristles to touch the aluminum wheel parts. However, several factors tend to cause too much penetration:

(a) the operator may be using too much pressure (either spring or hydraulic pressure) to push the brush against the side of the tire;

(b) the width of cars can vary significantly, and hence the wider cars themselves tend to result in greater pressure between the brush and tire due to the manner in which the support for the brush automatically urges the brush inwardly for engagement with the tire;

(c) the use of balloon tires on vehicles increases the brush penetration and pressure; and (d) the wheel washing unit stops may not be adjusted to allow the brush to move far enough away from the path of vehicle travel, particularly for wider cars.

As is apparent from the above, not all of the parameters which control wheel pressure can be controlled by the operator of the washing apparatus. However, even when all of the above factors have been adjusted or remedied to the maximum extent possible by the operator, there is still a danger of causing damage to the aluminum parts since the above parameters obviously require extremely close control and constant adjustment in order to finely balance the optimum conditions required to permit proper cleaning of the white sidewall tires without damaging the aluminum wheel parts.

The problem of cleaning the white sidewalls associated with vehicle wheels employing aluminum parts, however, is made even more difficult by tire design changes. Vehicle and tire manufacturers have modified the tire designs such that the white sidewalls have been lowered closer to the floor, and the gap between the white sidewall and the aluminum wheel (or rim) has been reduced. The net result is that the rim itself is positioned closer to the floor or surface on which the tire rolls. There is less available space for engaging and cleaning the sidewall of the tire at the lowermost portion thereof. On the other hand, the car wash apparatus normally employs a roller which travels along near the floor and engages directly behind the vehicle tire so as to push the vehicle along the washing path. The presence of this roller necessitates that the tire brush itself be positioned at least a few inches upwardly above the floor so as to provide clearance for the pushing roller, and this coupled with the tendency for the wheel rims to be positioned lower relative to the floor, makes it virtually impossible for the tire brush to contact and clean the sidewalls of the tire without also making rather significant contact with the aluminum wheel parts.

Accordingly, the present invention relates to a tire brush designed for use in a car wash apparatus, which tire brush is believed to represent a significant improvement in that it is capable of providing satisfactory cleaning of white sidewall tires while minimizing the potential of damage to aluminum wheel parts.

In the improved tire brush of this invention, the brush includes a large plurality of radially projecting bristles which define an axially elongated cylindrical array. This cylindrical array of bristles is itself defined by a first cylindrical array formed by stiff abrasive bristles, such as silicon carbide-impregnated nylon bristles. This first cylindrical array of abrasive bristles is of a first diameter. The overall cylindrical bristle array includes a second cylindrical array of bristles having a second diameter which is greater than said first diameter, this different in diameter typically being in the range of from one to two inches. The bristles of the second cylindrical array are, in relationship to the abrasive bristles of the first cylindrical array, of low abrasiveness and hence are hereinafter referred to as the nonabrasive bristles. These nonabrasive bristles are typically of a plastic material, such a polypropylene or nylon, and are free of abrasives. The bristles of this second cylindrical array are stiff so as to control the penetration of the brush against the wheel, whereby they will permit sufficient penetration so that the abrasive bristles of the first cylindrrcal array can clean the white sidewalls, while at the same time these abrasive bristles will not make any significant contact with the aluminum parts so that the latter are cleaned by the tips of the nonabrasive bristles defining the second cylindrical array. The bristles defining the first and second cylindrical array are generally uniformly dispersed circumferentially and axially of the brush to provide for optimum and uniform cleaning.

In the improved tire brush of the present invention, the free outer end portions of the nonabrasive bristles are preferably split or "flagged", whereby the free end portion of each nonabrasive bristle defines a large number of very small fiberlike end parts which are relatively soft. These flagged ends provide a soft and fluffy outer layer around the brush which is not only highly effective for cleaning the wheel and specifically the aluminum wheel parts, but this outer fluffy layer is also highly effective for retaining the milder cleaning solution that is used in conjunction with the tire brush, thereby further improving the effectiveness of the cleaning action. The flagged ends of the nonabrasive bristles extend inwardly of the bristle through a length which is less than the difference in the radial lengths of the abrasive and nonabrasive bristles, whereby the nonflagged portions of the nonabrasive bristles project radially outwardly and define a diameter which is slightly greater than the diameter of the abrasive bristles to hence control penetration of the tire into the brush. Further, the flagged ends of the nonabrasive bristles will continue to flag as the brush is worn and the overall brush diameter becomes smaller, so that the effectiveness of the softer flagged ends will continue as the brush is being used. However, because the bristles defining the second diameter are nonabrasive, they have less tendency to wear than the abrasive bristles, and hence the second diameter will continue to remain larger than the first diameter even as the brush undergoes wear.

Other objects and purposes of the invention will be apparent to persons familiar with brushes of this general type upon reading the following specification and inspecting the accompanying drawings.

Figure 1:
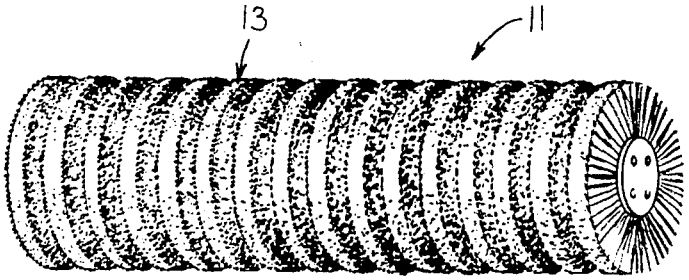
FIG. 1 is a perspective view of a tire brush according to the present invention.

Certain terminology will be used in the following description for convenience in reference only, and will not be limiting. For example, the words "rightwardly", "leftwardly", "upwardly" and "downwardly" will refer to directions in the drawings to which reference is made. The words "inwardly" and "outwardly" will refer to directions toward and away from, respectively, the geometric center of the brush and designated parts thereof. Said terminology will include the words specifically mentioned, derivatives thereof, and words of similar import.

DETAILED DESCRIPTION

FIG. 1 diagrammatically illustrates a tire brush 11 according to the present invention. This brush, as is conventional, includes a large plurality of bristles which are disposed in an axially elongated cylindrical array, which bristles are mounted to and project outwardly from a central axially elongated support shaft 12, the latter conventionally comprising a tube. This support shaft 12 has the cylindrical array of bristles 13 projecting outwardly therefrom, and the opposite axial ends of the support shaft 12 is normally provided with some type of mounting hub 14 for permitting the brush to be removably associated with a conventional mounting structure which enables the tire brush to be pushed sidewardly so that the bristles engage the side of the vehicle wheel. This sideward displacement of the tire brush occurs in the radial direction thereof, and simultaneously therewith the tire brush is rotated about its longitudinally extending axis 15. The tire brush is conventionally oriented so that this axis 15 extends approximately horizontally.

Figure 2:
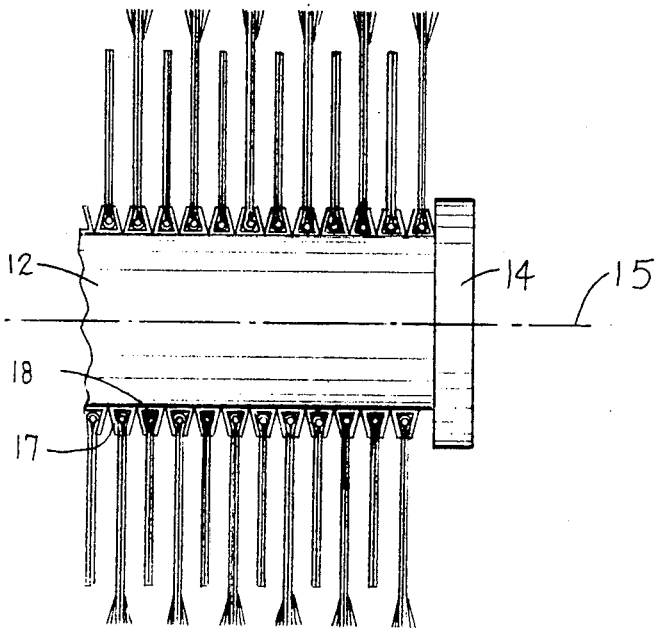
FIG. 2 is an enlarged, fragmentary, partial axial sectional view of the brush.

The bristles defining the cylindrical array 13 can be secured to the support shaft 12 in any conventional manner. One known technique is illustrated by FIG. 2. In this known technique, an elongated securing channel 17 is wrapped around the periphery of the central shaft 12. This securing shaft 17 retains the bristles therein, this retention occurring due to the bristle filaments being folded around an elongated cable 18. This cable is disposed within the channel 17, with opposite ends of the cable being suitably anchored so as to securely hold the bristles within the channel. The filaments are folded over, substantially at their midpoints, so that each filament defines two radially outwardly projecting bristles.

In the illustrated embodiment, the securing channel comprises a single continuous elongated channel which is spirally wrapped around the central shaft 12. The spirally wrapped channel 17 defines a plurality of annular convolutions which, in the illustrated embodiment, are disposed closely axially adjacent one another throughout the axial length of the brush.

The use of a securing channel and cable arrangement for mounting the bristles is conventional, and is disclosed solely for purposes of illustration. It will be well recognized that numerous other conventional securing structures can be utilized for attaching the bristles to the central shaft or core.

In the improved brush 11 of this invention, the cylindrical bristle array 13 is defined by two parts, namely a first cylindrical array defined by bristles 21, and a second cylindrical array defined by bristles 22.

The bristles 21 are stiff and abrasive. More particularly, the bristles 21 are normally of a plastic material having abrasive particles impregnated or embedded therein. In the preferred embodiment, these bristles 21 comprise nylon filaments having silicon carbide impregnated therein as an abrasive. Such filaments are sold by DuPont under the trademark TYNEX "A". These abrasive bristles 21 are disposed in a fairly uniform pattern so as to extend both circumferentially around and axially along the brush and hence define said first cylindrical array, which array has an outer diameter (as defined at the outer free ends or tips of the bristles) designated $D_1$ in FIG. 3.

The other bristles 22 are, in comparison to the properties of the bristles 21, nonabrasive. That is, the bristles 22 are free of abrasives in that they do not have abrasives embedded or impregnated therein. These bristles 22 preferably comprise plastic filaments, such as either polypropylene or nylon filaments, whereby the bristles 22 are stiff but nonabrasive. These nonabrasive bristles 22 are also disposed in a substantially uniform pattern which extends both circumferentially around and axially along the brush. These nonabrasive bristles 22 themselves define a second substantially cylindrical array having an outer diameter $D_2$ in FIG. 3. The diameter $D_2$ of this second cylindrical array is larger than the diameter $D_1$ of the first cylindrical array. More specifically, the diameter $D_2$ is preferably in the range of about one to two inches greater than the diameter $D_1$.

The nonabrasive bristles 22 are preferably split or "flagged" at their outer or tip ends. This flagging of the tip ends of the bristles 22 causes the tip ends to be axially split inwardly over a short length from the free end thereof, so that the bristle is hence divided into a large number of fiberlike end parts 23. This splitting or flagging of the tip ends causes formation of the end parts 23 over a very short axial length of the bristle, and in fact the flagged or end parts 23 normally have a length in the range of about ¼ to about ⅜ inch. The flagging of bristle tips is a conventional practice, and has previously been carried out in the vehicle brush art.

This flagging of the tips of the nonabrasive bristles 22 provides the nonabrasive bristles, at their tip ends, with a soft and fluffy characteristic since each nonabrasive bristle 22 has at its free end a large number of smaller cross section tip portions which are of short length but are necessarily of much less stiffness. The outer surface of the brush hence has a significantly softer and more dense characteristic. In fact, the short axial depth created by the flagged ends 23 results in the brush having an outer layer, effectively as defined between the diameters $D_2$ and $D_3$ in FIG. 3, which is of a soft and fluffy characteristic. The outer fluffy layer is highly effective for retaining cleaning solutions to improve the effectiveness of the cleaning operation carried out by the brush.

As noted above, the flagged ends 23 project inwardly over only a small extent, and hence result in the cylindrical array of nonabrasive bristles 22 defining the outer diameter $D_1$ which provides a soft and fluffy outer characteristic to the brush. At the same time, the cylindrical array of nonabrasive bristles 22 defines an inner diameter $D_3$ which defines the radially outermost point of the nonabrasive bristles 22 which do not include the flagged ends. This diameter $D_3$ in effect defines an envelope within which the nonabrasive bristles 22 are not flagged, and hence these bristles 22 within the diameter $D_3$ still retain their stiffness so as to provide more effective control of the penetration of the vehicle tire into the brush. This diameter $D_3$ is greater than the diameter $D_1$. That is, the radial inward extent of the flagging, and the radial extent of the flagged ends 23, is less than the radial length differential between the bristles 21 and 22 so that the bristles 22 still retain a stiff characteristic having a radial dimension (as defined by the diameter $D_3$) which is greater than the radial dimension of the abrasive bristles 21 (as defined by the diameter $D_1$).

The bristles 21 and 22 which define the respective first and second cylindrical arrays of diameters $D_1$ and $D_2$ have the individual bristles interspersed in a substantially uniform pattern so as to provide uniform brushing and cleaning properties when the brush is in use. This dispersement of the bristles of one array within the other array can obviously be achieved using many different attachment techniques, and hence the use of the channel 16 and cable 17 and the dispersement pattern of the present invention is only exemplary of one desirable means of achieving the present invention.

In the illustrated embodiment, the abrasive bristles 21 are secured to the central shaft 12 and project radially outwardly therefrom due to the bristles being mounted within axially alternate convolutions of the securing channel 17. The abrasive bristles 21 are positioned so as to extend substantially throughout the full 360° of the axially alternate convolutions.

Similarly, the nonabrasive bristles 22 are also mounted within and project axially outwardly from axially alternate convolutions of the securing channel 17, with the bristles 22 being secured within those convolutions of the securing channel which are disposed axially between the convolutions which mount therein the abrasive bristles 21. The bristles 22, like the bristles 21, extend through approximately the full 360° of the respective convolution.

Figure 3:
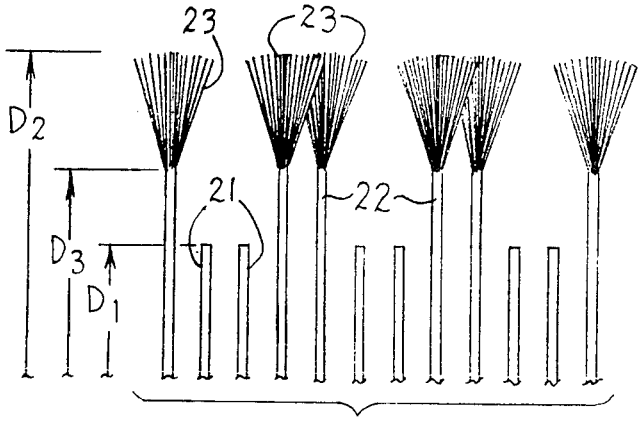
FIG. 3 diagrammatically illustrates the diametral relationships which exist between the bristles associated with the brush.

The arrangement of the first and second cylindrical arrays as defined by the bristles 21 and 22, respectively , results in a pattern which, viewed in axial cross section, resembles the diagrammatic illustration of FIGS. 2 and 3. That is, the first or endmost convolution $17_1$ contains therein the nonabrasive bristles 22, the next adjacent convolution $17_2$ contains therein the abrasive bristles 21, the next adjacent convolution $17_3$ again contains therein the nonabrasive bristles 22, the next adjacent convolution $17_4$ again contains therein the abrasive bristles 21, and this pattern repeats axially throughout the length of the brush. This results in the brush effectively having axially alternating annular bands or regions of abrasive and nonabrasive bristles. However, due to the greater diameter of the nonabrasive bristles 22 and the presence of the flagged ends 23 thereon, the flagged ends 23 in effect tend to axially overlap the outer free ends of the intermediate annular bands defined by the shorter abrasive bristles 21, and accordingly provide the brush with what appears to be a rather dense and uniform bristle configuration.

While the illustrated embodiment discloses axially adjacent and alternating annular bands of abrasive and nonabrasive bristles, it will be appreciated that the adjacent bands of abrasive and nonabrasive bristles can extend axially of the brush, with such bands being alternated radially around the brush if desired. Further, the bristles 21 and 22 can be more uniformly intermixed both circumferentially and/or axially, subject only to the restraints imposed thereon by feasible and satisfactory manufacturing and assembly techniques.

With the improved brush 11 of the present invention, the larger diameter $D_2$ of the nonabrasive bristles 22 helps prevent the tire from penetrating radially too far into the brush by pushing the brush away from the tire. However, if too much penetration occurs, then the diameter $D_3$ of the stiff nonabrasive bristles 22 tend to restrict or prevent further penetration and hence maintain the abrasive bristles 21 out of contact with the aluminum wheel parts. At the same time, however, these abrasive bristles can make sufficient contact with the sidewall of the tire since it normally protrudes outwardly a greater extent than the aluminum wheel parts. The aluminum wheel parts in turn are effectively cleaned by the softer and nonabrasive bristles 22 without causing any damage thereto. Further, the outer fluffy layer defined by the flagged ends 23 greatly assists in retaining the mild cleaning solution that is used in conjunction with the tire brush, which retention further facilitates effective cleaning of the sidewall.

In the tire brush, the central shaft 12 typically has a diameter of about two inches. The maximum outer diameter of the tire brush, namely the diameter $D_2$, is typically in the range of about six to eight inches. The overall tire brush has an axial length which is typically several times greater than its maximum diameter.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. Improvements in a rotary tire brush for a vehicle washing appartus, said tire brush having an axially elongated central support shaft, and a plurality of bristles which are anchored relative to and project radially outwardly from said central shaft, said bristles being arranged in a cylindrical array which concentrically surrounds and extends axially along the central shaft, comprising the improvement wherein:

said plurality of bristles including a first plurality of abrasive bristles which are anchored to said central shaft and project radially outwardly therefrom both circumferentially and axially thereof for defining a first cylindrical array which concentrically surrounds the central shaft and extends axially therealong, said first cylindrical array having a first outer diameter as defined by the radially outer tip ends of said abrasive bristles;

said plurality of bristles including a second plurality of stiff nonabrasive bristles which are anchored to said central shaft and project radially outwardly therefrom both circumferentially and axially for defining a second cylindrical array in concentric and axially extending relationship relative to said central shaft, said second cylindrical array having a second outer diameter as defined by the radially outer tip ends of said nonabasive bristles, said second outer diameter being significantly larger than said first diameter;

the abrasive bristles of said first cylindrical array being interspersed in a uniform pattern both axially and circumferentially within the nonabrasive bristles defining said second cylindrical array so that said first and second cylindrical arrays extend axially between substantially the same axial limits; and the tip ends of only the non-abasive bristles being flagged to define a plurality of filament-like elements which project inwardly along the nonabasive bristle through a short radial extent so as to define on the tip ends of the nonabrasive bristles an outer fluffy layer.

2. A brush according to claim 1, wherein the filamentlike elements project inwardly along the nonabrasive bristle through a short radial extent which is less than the radial difference between said first and second diameters.

3. A brush according to claim 2, wherein the abrasive bristles comprise nylon filaments impregnated with an abrasive, and wherein the nonabrasive bristles comprise plastic filaments which are free of abrasives.

4. A brush according to claim 2, wherein said second diameter is in the range of about six to eight inches, and wherein said first diameter is in the range of about one to two inches smaller than said second diameter.

5. A brush according to claim 2, wherein the flagged ends of said nonabrasive bristles extend radially inwardly of the brush through a small distance which is less than the radial difference between said first and second diameters, said abrasive bristles being free of flagged ends.

6. A brush according to claim 5, wherein the nonabrasive bristles defining said second cylindrical array are disposed within a plurality of annular bands which surround the central shaft and are disposed in axially spaced relationship therealong, and wherein the abrasive bristles defining the first cylindrical array are also disposed within a plurality of annular bands which surround said central shaft and are disposed in axially spaced relationship therealong, the annular bands of said first and second cylindrical arrays being disposed in axially alternating relationship along said central shaft.

7. A brush according to claim 1, wherein the nonabrasive bristles defining said second cylindrical array are disposed within a plurality of annular bands which surround the central shaft and are disposed in axially spaced relationship therealong, and wherein the abrasive bristles defining the first cylindrical array are also disposed within a plurality of annular bands which surround said central shaft and are disposed in axially spaced relationship therealong, the annular bands of said first and second cylindrical arrays being disposed in axially alternating relationship along said central shaft.

* * * * *

UNITED STATES PATENT AND TRADEMARK OFFICE

CERTIFICATE OF CORRECTION

PATENT NO. : 4 756 044

DATED : July 12, 1988

INVENTOR(S) : Gaylord J. Clark

It is certified that error appears in the above-identified patent and that said Letters Patent is hereby corrected as shown below:

Column 7, line 30; change "axially for" to ---axially thereof for---.

Column 7, line 45; change "filament-like" to ---filamentlike---.

Column 7, line 44; change "non-abasive" to ---non-abrasive---.

Signed and Sealed this

Twenty-fourth Day of January, 1989

*Attest:*

DONALD J. QUIGG

*Attesting Officer*

*Commissioner of Patents and Trademarks*